US010798516B2

(12) United States Patent
Hayashi et al.

(10) Patent No.: US 10,798,516 B2
(45) Date of Patent: Oct. 6, 2020

(54) INFORMATION PROCESSING APPARATUS AND METHOD

(71) Applicant: SONY CORPORATION, Tokyo (JP)

(72) Inventors: Shigetoshi Hayashi, Kanagawa (JP); Kohei Asada, Kanagawa (JP); Yushi Yamabe, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/098,637

(22) PCT Filed: Apr. 27, 2017

(86) PCT No.: PCT/JP2017/016666

§ 371 (c)(1),
(2) Date: Nov. 2, 2018

(87) PCT Pub. No.: WO2017/195616

PCT Pub. Date: Nov. 16, 2017

(65) Prior Publication Data

US 2019/0149940 A1 May 16, 2019

(30) Foreign Application Priority Data

May 11, 2016 (JP) ..... 2016-095430

(51) Int. Cl.
*H04S 7/00* (2006.01)
*H04R 5/027* (2006.01)
(Continued)

(52) U.S. Cl.
CPC ..... *H04S 7/307* (2013.01); *H04R 5/027* (2013.01); *H04R 5/04* (2013.01); *H04R 29/00* (2013.01);
(Continued)

(58) Field of Classification Search
CPC ..... H04S 7/307; H04S 7/304; H04S 2400/15; H04S 7/303; H04R 5/027; H04R 25/552; H04R 5/04; H04N 21/422; G06F 3/0213
See application file for complete search history.

(56) References Cited

U.S. PATENT DOCUMENTS 4,143,244 A * 3/1979 Iwahara ..... H04S 1/005 381/310
4,388,494 A * 6/1983 Schone ..... H04R 5/027 381/1
(Continued)

FOREIGN PATENT DOCUMENTS

JP 54-58402 A 5/1979
JP 2001-525141 A 12/2001
(Continued)

OTHER PUBLICATIONS

Maijala, Better Binaural Recording Using the real human head (Year: 1997).*
(Continued)

*Primary Examiner* — Davetta W Goins
*Assistant Examiner* — Kuassi A Ganmavo
(74) *Attorney, Agent, or Firm* — Chip Law Group

(57) ABSTRACT

The present disclosure relates to an information processing apparatus and method capable of performing compensation to achieve a standard sound regardless of a recording environment. The microphone picks up sound from a sound source and inputs the sound to a recording apparatus as an analog audio signal. The recording apparatus is an apparatus that performs binaural recording and generates an audio file of a sound obtained by binaural recording. The recording apparatus adds metadata related to a recording environment of binaural content to the audio file generated by binaural recording and transmits the file with the metadata to a reproducing apparatus. The present disclosure is applicable
(Continued)

to a recording/reproducing system that performs binaural recording and reproduction of the sound, for example.

14 Claims, 16 Drawing Sheets

(51) Int. Cl.
*H04R 29/00* (2006.01)
*H04S 1/00* (2006.01)
*H04R 5/04* (2006.01)

(52) U.S. Cl.
CPC ..... *H04S 1/005* (2013.01); *H04S 7/303* (2013.01); *H04S 7/304* (2013.01); *H04S 2400/15* (2013.01); *H04S 2420/01* (2013.01)

(56) References Cited

U.S. PATENT DOCUMENTS 6,402,782 B1 6/2002 Sibbald et al.
6,829,361 B2 * 12/2004 Aarts ..... H04S 3/004 381/17
9,591,427 B1 * 3/2017 Lyren ..... G06K 9/00228
2004/0013271 A1 * 1/2004 Moorthy ..... H04S 1/002 381/1
2006/0245305 A1 * 11/2006 Aarts ..... H04S 1/005 369/1
2006/0274901 A1 12/2006 Terai et al.
2008/0004866 A1 * 1/2008 Virolainen ..... G10L 19/008 704/205
2009/0208027 A1 * 8/2009 Fukuda ..... H04R 3/02 381/71.6
2011/0170700 A1 * 7/2011 Miseki ..... H04R 3/04 381/71.6
2013/0003981 A1 * 1/2013 Lane ..... H04R 29/001 381/58
2015/0073262 A1 * 3/2015 Roth ..... A61B 5/1077 600/411
2016/0277836 A1 * 9/2016 Palacino ..... H04S 7/301
2018/0063641 A1 * 3/2018 Lyren ..... H04R 5/027

FOREIGN PATENT DOCUMENTS

JP 2003-264899 A 9/2003
JP 2005244664 A * 9/2005
JP 2007-187749 A 7/2007
WO 9852382 A1 11/1998
WO 2005/025270 A1 3/2005

OTHER PUBLICATIONS

International Search Report and Written Opinion of PCT Application No. PCT/JP2017/016666, dated Jul. 4, 2017, 02 pages of English Translation and 08 pages of ISRWO.

* cited by examiner

INFORMATION PROCESSING APPARATUS AND METHOD

CROSS REFERENCE TO RELATED APPLICATIONS

This application is a U.S. National Phase of International Patent Application No. PCT/JP2017/016666 filed on Apr. 27, 2017, which claims priority benefit of Japanese Patent Application No. JP 2016-095430 filed in the Japan Patent Office on May 11, 2016. Each of the above-referenced applications is hereby incorporated herein by reference in its entirety.

TECHNICAL FIELD

The present disclosure relates to an information processing apparatus and method, and more particularly relates to an information processing apparatus and method capable of performing compensation to achieve a standard sound regardless of a recording environment.

BACKGROUND ART

Patent Document 1 proposes a binaural recording apparatus having a headphone-shaped mechanism and using a noise canceling microphone.

CITATION LIST

Patent Document

Patent Document 1: Japanese Patent Application Laid-Open No. 2009-49947

SUMMARY OF THE INVENTION

Problems to be Solved by the Invention

However, since the physical characteristics of a listener such as the shape and size of the ear are different from those of a dummy head used for recording (or a recording environment using human ears), reproducing recorded content as it is might not lead to acquisition of high realistic feeling.

The present disclosure has been made in view of such a situation, and aims to enable compensation to achieve a standard sound regardless of the recording environment.

Solutions to Problems

An information processing apparatus according to an aspect of the present technology includes a transmission unit that transmits metadata related to a recording environment of binaural content, together with the binaural content.

The metadata is an interaural distance of a dummy head or a human head used in the recording of the binaural content.

The metadata is a use flag indicating which of a dummy head and human ears is used in the recording of the binaural content.

The metadata is a position flag indicating which of a vicinity of an eardrum or a vicinity of a pinna is used as a microphone position in the recording of the binaural content.

In the case where the position flag indicates the vicinity of the pinna, compensation processing is performed in the vicinity of 1 kHz to 4 kHz.

Reproduction time compensation processing being ear canal characteristic compensation processing when an ear hole is closed is performed in accordance with the position flag.

The reproduction time compensation processing is performed so as to have dips in the vicinity of 5 kHz and vicinity of 7 kHz.

The metadata is information regarding a microphone used in the recording of the binaural content.

The apparatus further includes a compensation processing unit that performs recording time compensation processing for compensating for a sound pressure difference in a space from a position of sound source to a position of a microphone in the recording, in which the metadata includes a compensation flag indicating whether or not the recording time compensation processing has been completed.

In an information processing method according to an aspect of the present technology, an information processing apparatus transmits metadata related to a recording environment of binaural content, together with the binaural content.

An information processing apparatus according to another aspect of the present technology includes a reception unit that receives metadata related to a recording environment of binaural content, together with the binaural content.

The apparatus can further include a compensation processing unit that performs compensation processing in accordance with the metadata.

The reception unit can receive transmitted content selected by matching using a transmitted image.

In an information processing method according to another aspect of the present technology, an information processing apparatus receives metadata related to a recording environment of binaural content, together with the binaural content.

In one aspect of the present technology, metadata related to a recording environment of binaural content is transmitted together with the binaural content.

In another aspect of the present technology, metadata related to a recording environment of binaural content is received together with the binaural content.

Effects of the Invention

According to the present technology, it is possible to perform compensation to achieve a standard sound regardless of recording environment.

Note that effects described here in the present specification are provided for purposes of exemplary illustration and effects of the present technology are not intended to be limited to the effects described in the present specification, and still other additional effects may also be contemplated.

MODE FOR CARRYING OUT THE INVENTION

Hereinafter, embodiments of the present disclosure (hereinafter, embodiment(s)) will be described. Note that description will be presented in the following order.

1. First Embodiment (Overview)
2. Second Embodiment (System)
3. Third Embodiment (Application Example)

1. First Embodiment

<Overview>

In recent years, expansion of portable music players has shifted a listening environment of music to outdoors in many cases, leading to an increase of users who listen to music using their headphones. In addition, with this increase in the number of users using headphones, there is an expected future trend of playing binaural content recorded using a dummy head or human ears and reproducing sound effects of the human head using stereo earphones or stereo headphones.

This, however, has a problem of loss of realistic feelings in playing binaural content in some viewers or listeners. This is due to an occurrence of a physical characteristic difference between the dummy head (or shape of the head, etc. in the case of using human ears) used in the recording, and the viewer or listener. In addition, a difference between the sound pressure level in sound pickup and the sound pressure level in the reproduction might lead to the decrease in the realistic feeling.

Further, as is generally known, headphones and earphones have their individual frequency characteristics, by which a viewer or listener can comfortably play the music content by selecting headphones that match one's own preference. Still, these frequency characteristics of headphones are added to the content in reproduction of binaural content, leading to a decrease in realistic feeling depending on the headphones for reproduction. In addition, in a case where recording is performed using a noise canceling microphone in binaural recording that should pick up the sound of the eardrum position using a dummy head, an error of a recording position with respect to the eardrum position might affect realistic feelings.

The present technology is related to a compensation method used when binaural recording is performed using a dummy head or human ears and that allows the following data related to recording environment (situation) that might affect recording results, such as:

1. Information to be factors of individual difference, such as an interaural distance and the shape of the head; and
2. Information (frequency characteristics, sensitivity, etc.) regarding a microphone used in sound pickup, to be added as metadata to content so as to compensate for a signal on the basis of the metadata obtained in reproduction of the content, so as to be able to perform recording in standard sound quality and volume level regardless of type of device used, that is, independent of recording equipment or recording device, and so as to reproduce a signal of volume level and sound quality optimum for the viewer or listener.

<Configuration Example of Recording/Reproducing System>

Figure 1:
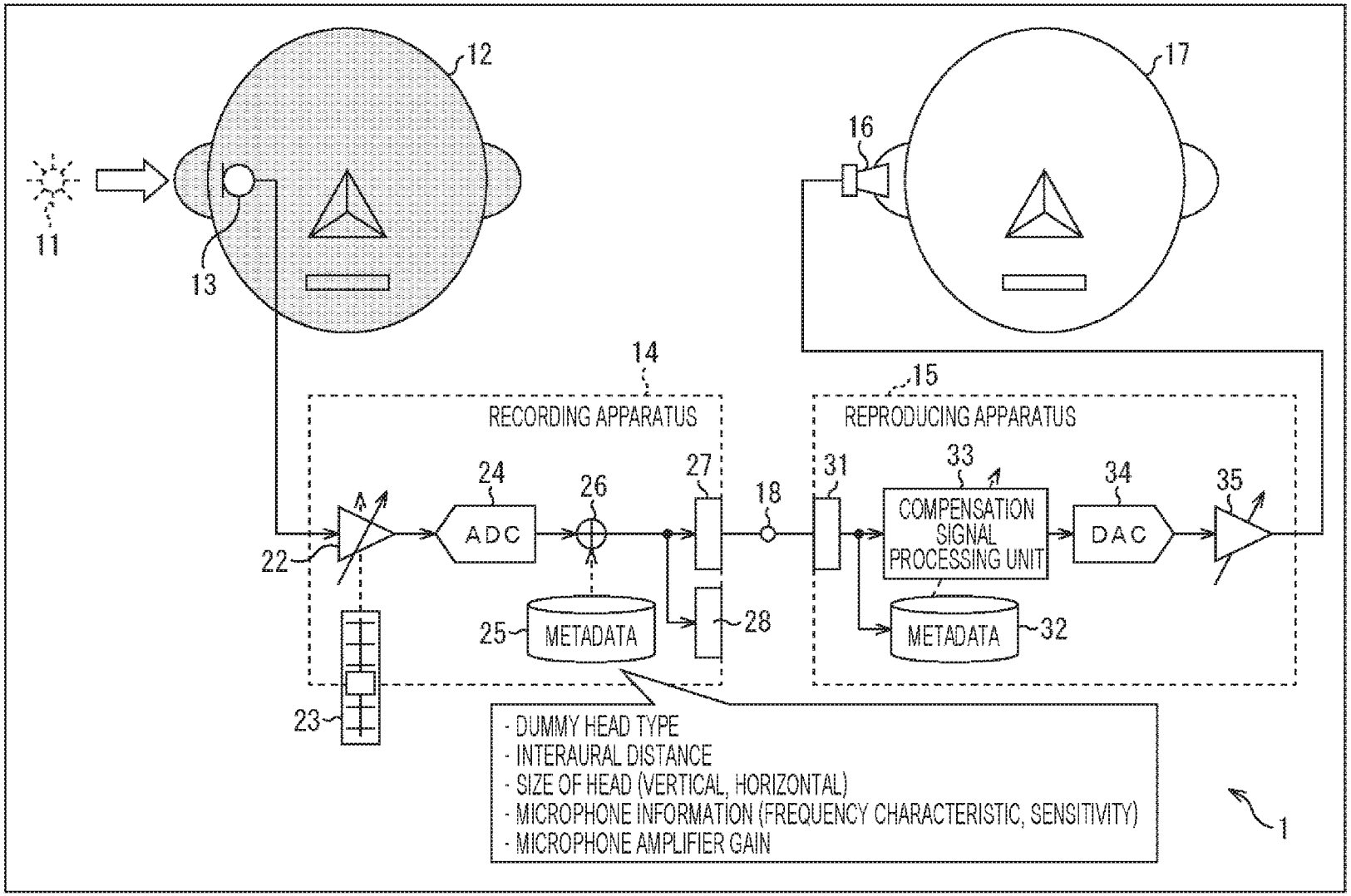
FIG. 1 is a block diagram illustrating a configuration example of a recording/reproducing system according to the present technology.

FIG. 1 is a diagram illustrating a configuration example of a recording/reproducing system according to the present technology. In the example of FIG. 1, a recording/reproducing system 1 performs recording and reproduction of binaural content. For example, the recording/reproducing system 1 includes: a sound source (source) 11: a dummy head 12, a microphone 13 installed at an eardrum position of the dummy head 12; a recording apparatus 14; a reproducing apparatus 15; headphones 16 to be worn on ears of a user 17 in use; and a network 18. Note that the example of FIG. 1 omits illustrations of a display unit and an operation unit in the recording apparatus 14 and the reproducing apparatus 15 for convenience of explanation.

The sound source 11 outputs a sound. The microphone 13 picks up the sound from the sound source 11 and inputs the sound to the recording apparatus 14 as an analog audio signal. The recording apparatus 14 serves as an information processing apparatus that performs binaural recording and generates an audio file of the sound recorded in binaural recording, while serving as a transmission apparatus that transmits the generated audio file. The recording apparatus 14 adds metadata related to a recording environment of the binaural content to the audio file generated by binaural recording and transmits the file with the metadata to the reproducing apparatus 15.

The recording apparatus 14 includes a microphone amplifier 22, a volume slider 23, an analog-digital converter (ADC) 24, a metadata DB 25, a metadata addition unit 26, a transmission unit 27, and a storage unit 28.

The microphone amplifier 22 amplifies an audio signal from the microphone 13 so as to have a volume level corresponding to an operation signal sent from the user with the volume slider 23, and outputs the amplified audio signal to the ADC 24. The volume slider 23 receives volume operation on the microphone amplifier 22 by the user 17 and transmits the received operation signal to the microphone amplifier 22.

The ADC 24 converts an analog audio signal amplified by the microphone amplifier 22 into a digital audio signal and outputs the digital audio signal to the metadata addition unit 26. The metadata database (DB) 25 holds data that might affect the recording and that is related to an environment (situation) in the recording, that is, physical characteristic data which can be a factor of individual difference, and the data of the device used for sound pickup, as metadata, and supplies the metadata to the metadata addition unit 26. Specifically, the metadata includes model number of the dummy head, the interaural distance of the dummy head (or human head), the size (vertical and horizontal) and shape of the head, hair style, microphone information (frequency characteristic and sensitivity), and gain of the microphone amplifier 22.

The metadata addition unit 26 adds the metadata from the metadata DB 25 to the audio signal from the ADC 24 and supplies the data as an audio file to the transmission unit 27 and the storage unit 28. The transmission unit 27 transmits the audio file to which the metadata has been added, to the network 18. The storage unit 28 includes a memory and a hard disk, and stores an audio file to which metadata has been added.

The reproducing apparatus 15 serves as an information processing apparatus that reproduces an audio file of sounds obtained by binaural recording, while serving as a reception apparatus. The reproducing apparatus 15 includes a reception unit 31, a metadata DB 32, a compensation signal processing unit 33, a digital-analog converter (DAC) 34, and a headphone amplifier 35.

The reception unit 31 receives an audio file from the network 18, obtains the audio signal and the metadata from the received audio file, supplies the obtained audio signal (digital) to the DAC 34, and accumulates the obtained metadata to the metadata DB 32.

The compensation signal processing unit 33 uses metadata to perform processing of compensating for individual difference in reproduction onto the audio signal from the reception unit 31 and generating an optimum signal for the viewer (listener). The DAC 34 converts the digital signal compensated by the compensation signal processing unit 33 into an analog signal. The headphone amplifier 35 amplifies the audio signal from the DAC 34. The headphones 16 output the sound corresponding to the audio signal from the DAC 34.

The headphones 16 are stereo headphones or stereo earphones to be worn on the head or ears of the user 17 to hear the reproduced content in reproduction of the content.

The network 18 is a network represented by the Internet. Note that while the recording/reproducing system 1 of FIG. 1 is a configuration example in which an audio file is transmitted from the recording apparatus 14 to the reproducing apparatus 15 via the network 18 and is received by the reproducing apparatus 15, the audio file may be transmitted from the recording apparatus 14 to a server (not illustrated), so as to be received by the reproducing apparatus 15 via the server.

Note that while the present technology adds metadata to a signal from a microphone, the microphone may be set at an eardrum position of a dummy head, or may be a binaural microphone designed to be used with a human ear or may be a noise canceling pickup microphone. Furthermore, the present technology is also applicable to a case where microphones installed for other purposes are functionally used at the same time.

As described above, the recording/reproducing system 1 of FIG. 1 has a function of adding metadata to the content recorded by binaural recording and transmitting the recorded content with metadata added.

<Compensation Processing During Recording>

Next, an example of compensation processing obtained by using metadata will be described with reference to FIG. 2. The example of FIG. 2 includes an example of binaural recording using a reference dummy head 12-1 and an example of binaural recording using a dummy head 12-2 used in recording.

On the reference dummy head 12-1, a spatial characteristic F from the sound source 11 at a specific position to the eardrum position at which the microphone 13-1 is installed is measured. In addition, on the dummy head 12-2 used in recording, a spatial characteristic G from the sound source 11 to the eardrum position at which the microphone 13-2 is installed is measured.

With these spatial characteristics preliminarily measured and recorded as metadata in the metadata DB 25, it is possible to perform conversion to a standard sound in reproduction by using the information obtained from the metadata.

Standardization of the recorded data may be performed before transmission of the signal or may be performed by adding, as metadata, coefficients and the like in equalizer (EQ) processing needed as metadata for compensation.

In addition, with execution of processing of holding and adding interaural distance of the head as metadata and widening (narrowing) a sound image, it is possible to record in further standardized sound. For convenience, this function will be referred to as recording time compensation processing. As additional description of this recording time compensation processing using mathematical expressions, a sound pressure P at the eardrum position recorded using the reference dummy head 12-1 is expressed by the following Formula (1).

[Mathematical Formula 1]

$$P=SFM_1 \tag{1}$$

In contrast, a sound pressure P' recorded using a non-standard dummy head (for example, the dummy head 12-2) is expressed by the following Formula (2).

[Mathematical Formula 2]

$$P'=SGM_2 \tag{2}$$

Here, $M_1$ is a sensitivity of the reference microphone 13-1, and $M_2$ is a sensitivity of the microphone 13-2. S represents a location (position) of the sound source. As described above, F is a spatial characteristic on the reference dummy head 12-1, from the sound source 11 at a specific position to the eardrum position at which the microphone 13-1 is installed. G is a spatial characteristic on the dummy head 12-2 used in recording, from the sound source 11 to the eardrum position at which the microphone 13-2 is installed.

From the above, with application of $EQ_1$ processing (equalizer processing) represented by the following Formula (3) as compensation processing in recording, it is possible to perform the recording in standard sound even with the use of a dummy head different from the reference.

[Mathematical Formula 3]

$$EQ_1 = \frac{FM_1}{GM_2} \tag{3}$$

Note that, in addition to the $EQ_1$ processing, processing of widening (narrowing) the sound image can be performed by using the interaural distance. With this processing, further realistic feeling can be expected.

<Compensation Processing During Reproduction>

Next, adjustment of sound pressure optimum for reproduction will be described with reference to FIG. 3. The recording/reproducing system 51 of FIG. 3 differs from the video recording/reproduction system 1 of FIG. 1 in that the reproducing apparatus 15 includes a reproduction time compensation processing unit 61 in place of the compensation signal processing unit 33 and that the omitted portion in FIG. 1, that is, a display unit 62 and an operation unit 63 are displayed in the recording/reproducing system 51 of FIG. 3.

Figure 3:
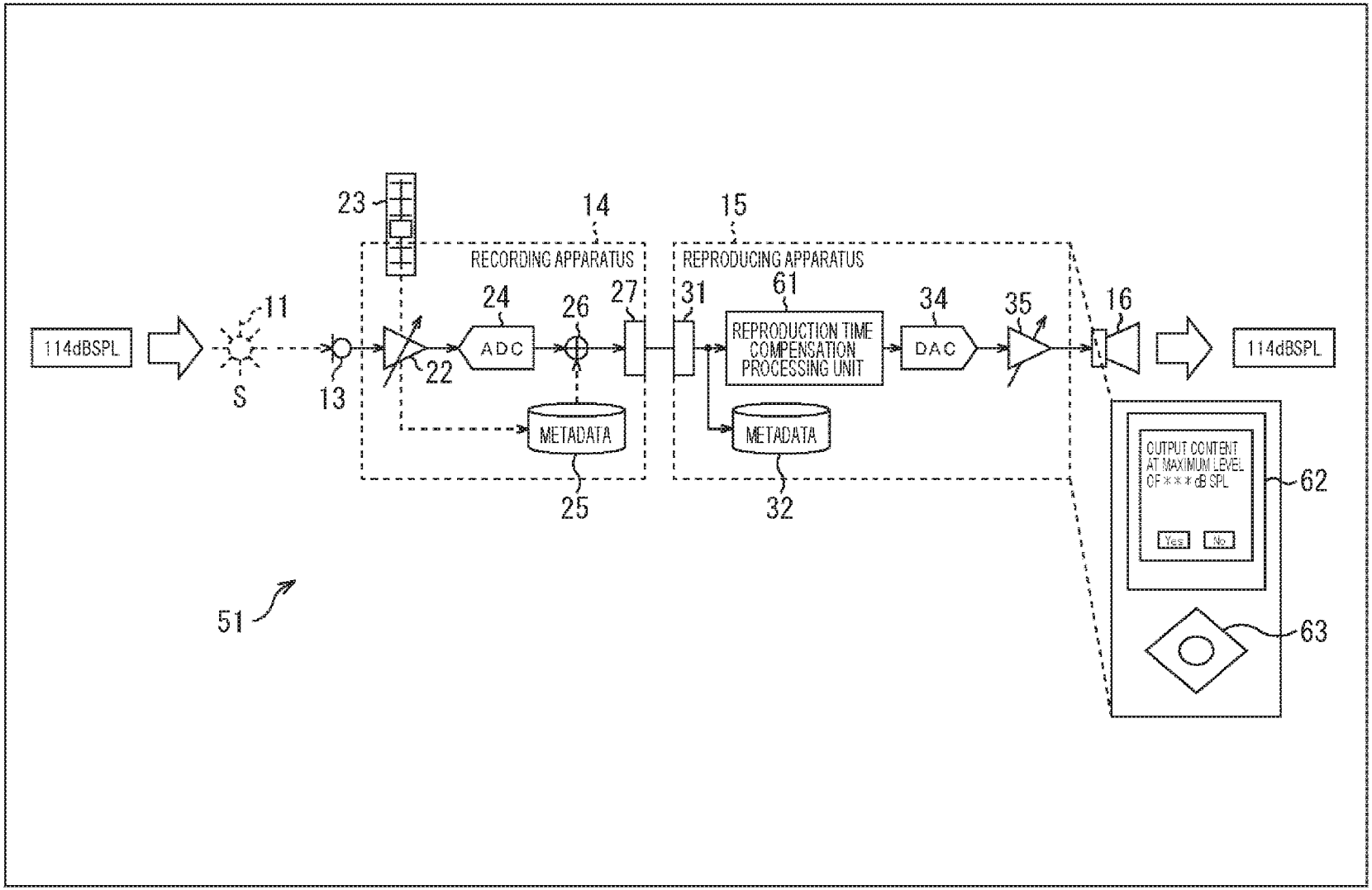
FIG. 3 is a diagram illustrating adjustment of optimum sound pressure in reproduction.

The recording apparatus 14 in FIG. 3 records microphone sensitivity information of the microphone amplifier 22 as metadata in the metadata DB 25, and uses the microphone sensitivity information for the reproducing apparatus 15, making it possible to set reproduction sound pressure of the headphone amplifier 35 to an optimum value. Note that implementation of this not only needs information regarding input sound pressure in recording but also needs sensitivity information of a driver for reproduction.

Furthermore, for example, the sound source 11 input at 114 dBSPL on the recording apparatus 14 can be output as sound at 114 dBSPL on the reproducing apparatus 15. At this time, that is, when the sound is adjusted to the optimum volume level on the reproducing apparatus 15, a confirmation message for the user is displayed beforehand on the display unit 62 or output as a voice guide. This makes it possible to adjust the volume level without surprising the user.

<Position Compensation in Use of Human Ears>

Next, the position compensation with the use of human ears will be described with reference to FIG. 4. Similarly to FIG. 2, the example of FIG. 4 includes an example of binaural recording using a reference dummy head 12-1, and an example of executing both binaural recording using the dummy head 12-2 and binaural recording using human ears.

Figure 4:
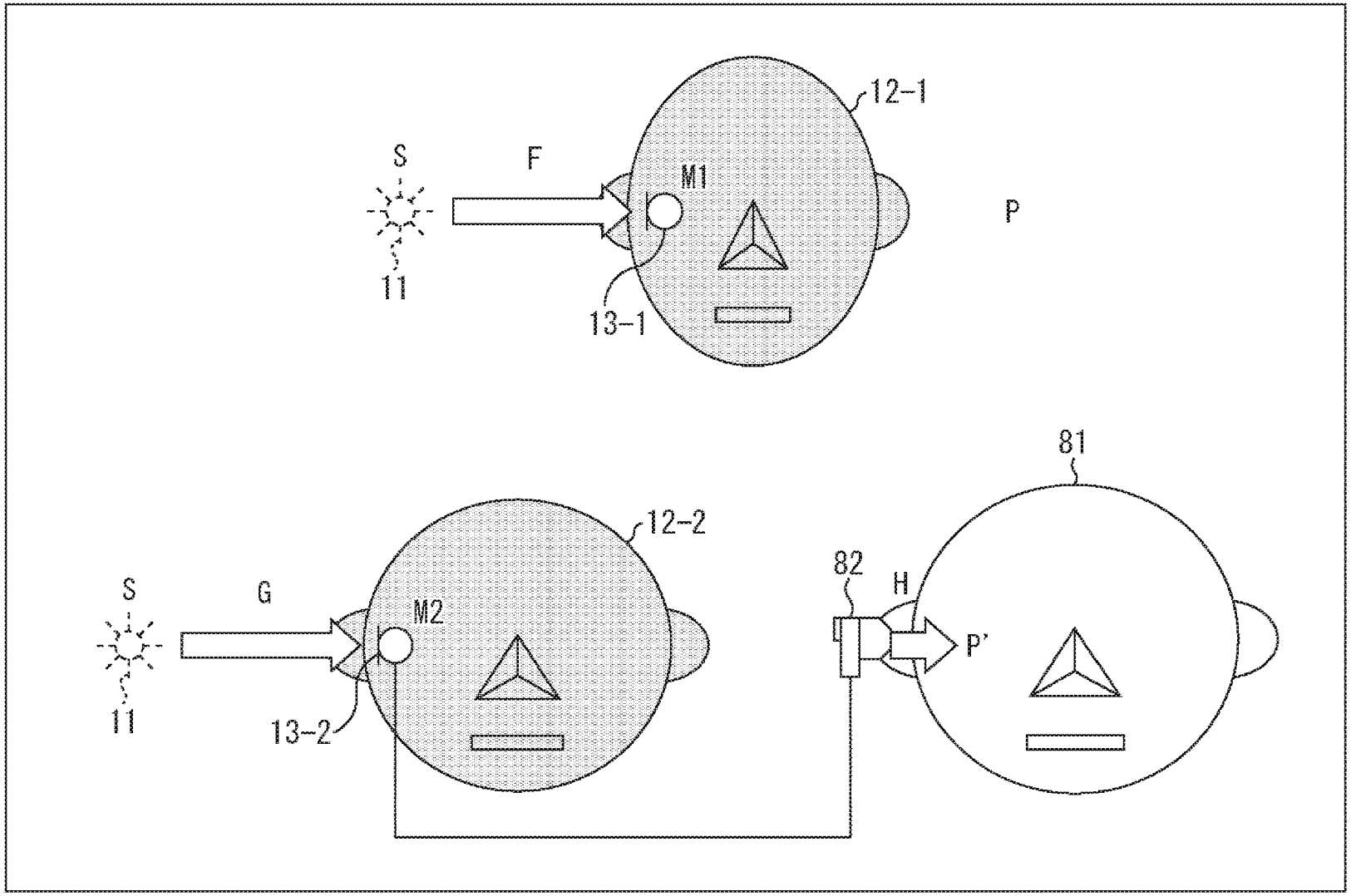
FIG. 4 is a diagram illustrating position compensation in the use of human ears.

As illustrated in FIG. 4, in a case where a user 81 picks up a sound by a human ear type binaural microphone 82, sound pickup is performed at a microphone position unlike the eardrum position in the cases of the dummy heads 12-1 and 12-2, and this needs compensation to obtain a target sound pressure at the microphone position and the eardrum position.

Accordingly, a human ear recording flag indicating that sound pickup has been performed using human ear type binaural microphone 82 is used as the metadata to perform compensation processing for obtaining an optimum sound at the eardrum position.

Note that while the compensation processing in FIG. 4 is equivalent to the recording time compensation processing described above with reference to FIG. 2, the compensation processing in FIG. 4 will be hereinafter referred to as recording time position compensation processing.

In describing this recording time position compensation processing using mathematical expressions, the sound pressure P at the eardrum position in the recording that is supposed to be performed at the eardrum position in the recording that is supposed to be performed at the eardrum position is expressed by the following Formula (4).

[Mathematical Formula 4]

$$P=SFM_1 \tag{4}$$

In contrast, the sound pressure P' at the microphone position when recording is performed using the human ear type binaural microphone 82 is expressed by the following Formula (5).

[Mathematical Formula 5]

$$P'=SGM_2 \tag{5}$$

Figure 2:
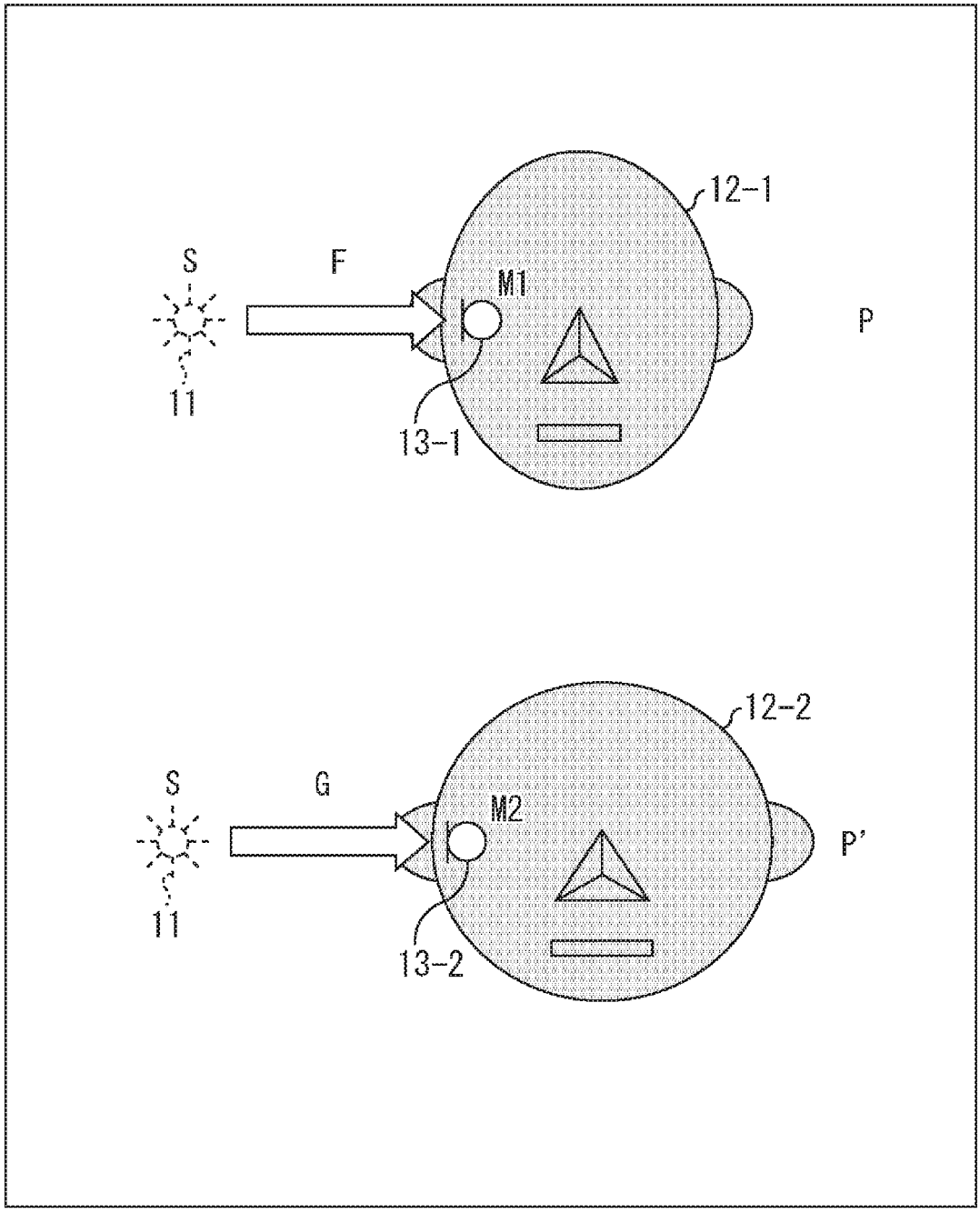
FIG. 2 is a diagram illustrating an example of compensation processing in recording.

Similarly to the case of FIG. 2, $M_1$ is the sensitivity of the reference microphone 13-1, while $M_2$ is the sensitivity of the microphone 13-2. S represents a location (position) of the sound source. As described above, F is a spatial characteristic on the reference dummy head 12-1, from the sound source 11 at a specific position to the eardrum position at which the microphone 13-1 is installed. G is a spatial characteristic on the dummy head 12-2 used in the recording, from the sound source 11 to the eardrum position at which the binaural microphone 82 (microphone 13-2) is installed.

From the above, with application of $EQ_2$ processing of the following Formula (6), it is possible to record in a standard sound even when a microphone at a position different from the eardrum position is used.

[Mathematical Formula 6]

$$EQ_2 = \frac{FM_1}{GM_2} \tag{6}$$

Note that in order to convert a signal of a microphone installed at a position other than the eardrum position into a standard signal at the eardrum position by using the metadata, there is a need to obtain a flag indicating that the binaural recording has been performed, a flag indicating that the recording has been performed using a microphone installed in the vicinity of the pinna using human ear rather than the eardrum position, and a spatial characteristic for a space from the sound source to the binaural microphone.

Figure 5A:
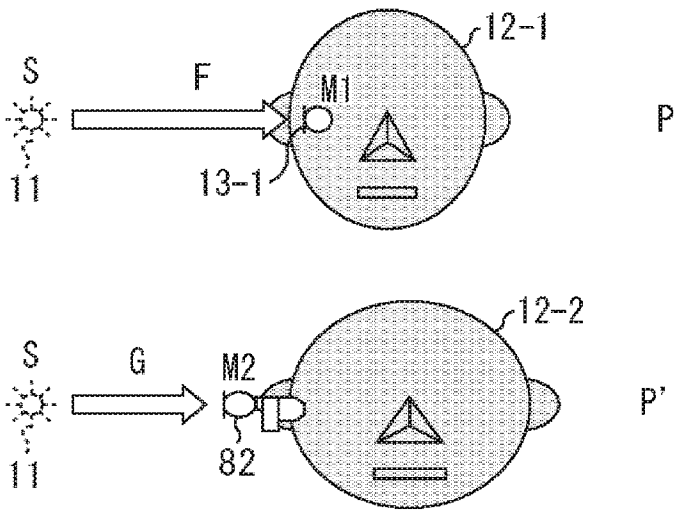
FIGS. 5A and 5B are diagrams illustrating position compensation in the use of human ears.

Here, in a case where the user 81 can measure the spatial characteristic using some method, user's own data may be used. In consideration of a case with no data, however, as illustrated in FIG. 5A, with the binaural microphone 82 installed in the standard dummy head 12-2 and with preliminarily measured spatial characteristics of a space from the sound source to the binaural microphone, then, it is possible to perform recording in a standard sound even for data recorded using human ears.

In addition, in an example of creating EQ2 used for recording time position compensation processing, the terms M1 and M2 in EQ2 are terms for compensating for a sensitivity difference of the microphones, while the difference in frequency characteristics mainly appears in the term of F/G. While F/G can be expressed as a difference in characteristics of a space from the microphone position to the eardrum position, the F/G characteristic is greatly affected by ear canal resonance, as illustrated by the arrow in FIG. 5B. That is, as standard data, with an exemplary resonance structure in which the pinna side is defined as an open end and eardrum side is defined as a closed end, the following EQ structure would be sufficient.

Having a peak in the vicinity of 3 kHz (1 kHz to 4 kHz)

Having a curve of 3 dB/oct in a range between 200 Hz and 2 kHz, toward the peak.

Figure 5B:
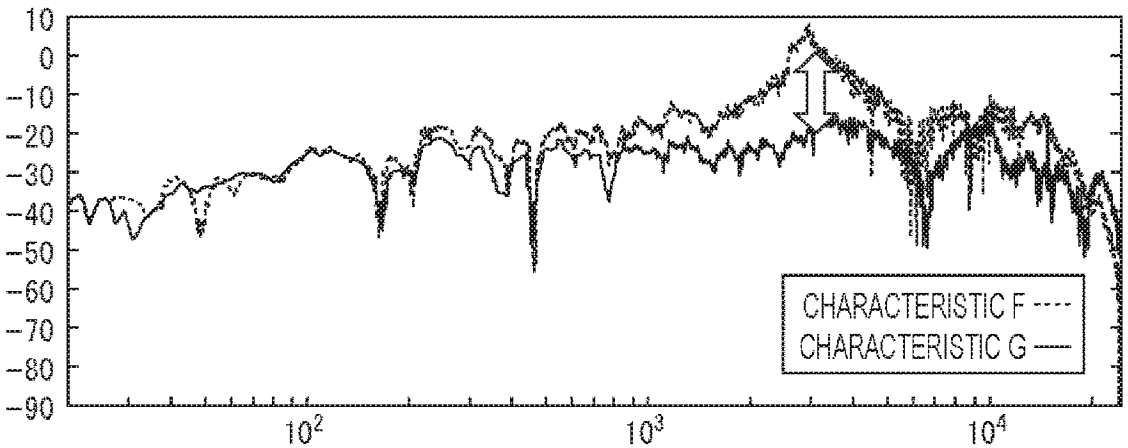
Figure 6:
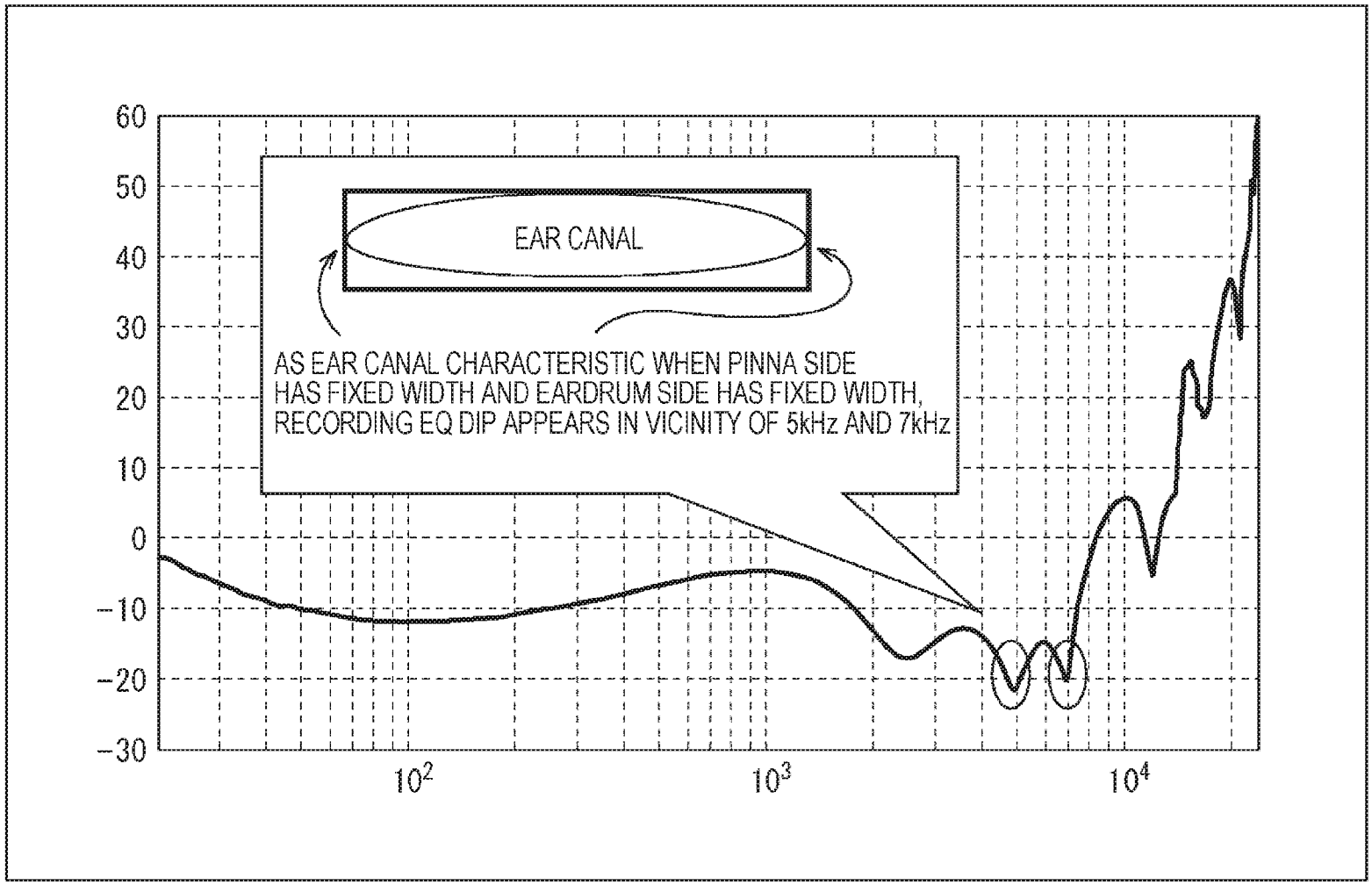
FIG. 6 is a diagram illustrating compensation for an effect on the ear canal in reproduction.

Note that while the examples illustrated in FIGS. 5A, 5B, and 6 are cases using binaural microphones, the description also applies to the case using a sound pickup microphone for human ear type noise canceler.

<Compensation for Effects on the Ear Canal in Reproduction>

Compensation processing performed in reproducing binaural content needs to be performed for both binaural recording content picked up at the eardrum position and content recorded using human ear.

That is, the content picked up at the eardrum position has already passed through the ear canal, and thus, reproducing binaural content using headphones or the like would be doubly affected by ear canal resonance. On the other hand, in recording binaural content using human ears, the above-described position compensation needs to be performed beforehand since the recording position and the reproduction position are not the same.

Accordingly, the compensation processing also needs to be performed for the content recorded by using human ears as well. Hereinafter, for convenience, this compensation processing will be referred to as reproduction time compensation processing. As additional description of compensation processing $EQ_3$ using a mathematical expression, as illustrated in FIG. 6, the $EQ_3$ is processing for correcting the ear canal characteristic at closure of the ear hole in addition to the frequency characteristic of the headphones.

The rectangle illustrated within a balloon represents the ear canal, in which the left side is defined as the pinna side as the fixed end while the right side is defined as the eardrum side as a fixed end, for example. In the case of such an ear canal, as illustrated in the graph of FIG. 6, a dip of recording EQ dip appears at in the vicinity of 5 kHz and vicinity of 7 kHz, as an ear canal characteristic.

Accordingly, as standard data, the following characteristics corresponding to ear canal resonance when an ear hole is closed would be sufficient.

Having a dip of about −5 dB in the vicinity of 5 kHz

Having a dip of about −5 dB in the vicinity of 7 kHz

While the compensation processing is performed as described above, the compensation processing can have a plurality of patterns depending on the position on which the compensation processing is applied. Next, exemplary systems for individual patterns will be described.

2. Second Embodiment

<Example of a Recording/Reproducing System According to the Present Technology>

Figure 7:
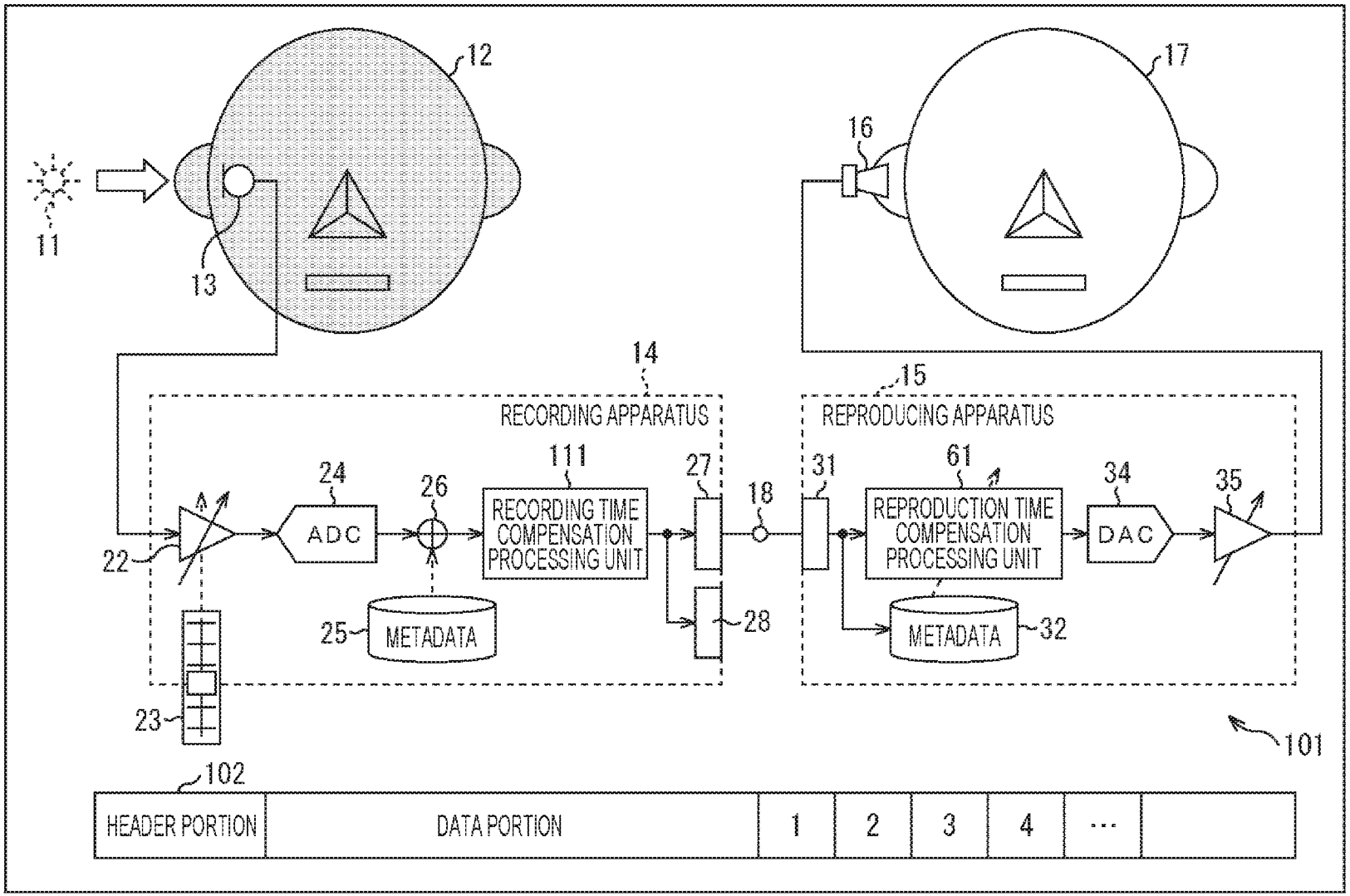
FIG. 7 is a block diagram illustrating an example of a recording/reproducing system in a case where recording time compensation processing is performed before transmission.

FIG. 7 is a diagram illustrating an example of a recording/reproducing system in a case where recording time compensation processing is performed before transmission. In the recording/reproducing system of the example of FIG. 7, the recording time compensation processing is executed from the characteristic difference between the two dummy heads before transmission to perform conversion to the standard sound and then transmission is performed, rather than adding information related to the reference dummy head and the dummy head used in the recording as metadata in the recording.

A recording/reproducing system 101 of FIG. 7 differs from the video recording/reproduction system 1 of FIG. 1 in that the recording apparatus 14 further includes a recording time compensation processing unit 111 and that the reproducing apparatus 15 includes the reproduction time compensation processing unit 61 in place of the compensation signal processing unit 33.

Further, the audio file 102 transmitted from the recording apparatus 14 to the reproducing apparatus 15 includes a metadata region to store metadata including a header portion, a data portion, and a flag. Examples of flags include: a binaural recording flag indicating whether or not the recording is binaural recording; a use discrimination flag indicating which of a dummy head and human ears microphone is used in the recording; and a recording time compensation processing execution flag indicating whether or not the recording time compensation processing has been performed. In the audio file 102 of FIG. 7, for example, a binaural recording flag is stored in the region indicated by 1 in a metadata region, a use discrimination flag is stored in the region indicated by 2, and a recording time compensation processing execution flag is stored in the region indicated by 3.

That is, the metadata addition unit 26 of the recording apparatus 14 adds the metadata from the metadata DB 25 to the audio signal from the ADC 24 to create a file, and supplies this file as an audio file 102 to the recording time compensation processing unit 111. The recording time compensation processing unit 111 performs recording time compensation processing on the audio signal of the audio file 102 on the basis of the characteristic difference between the two dummy heads. Then, the recording time compensation processing unit 111 turns on the recording time compensation processing execution flag stored in the region indicating 3 in the metadata region of the audio file 102. Note that the recording time compensation processing execution flag is set to off at a point of being added as metadata. The recording time compensation processing unit 111 supplies an audio file to which the recording time compensation processing has been applied and for which the recording time compensation processing execution flag is turned on, out of the metadata, to the transmission unit 27 and the storage unit 28.

The reception unit 31 of the reproducing apparatus 15 receives an audio file from the network 18, obtains the audio signal and the metadata from the received audio file, outputs the obtained audio signal (digital) to the DAC 34, and stores the obtained metadata to the metadata DB 32.

The compensation signal processing unit 33 confirms that the recording time compensation processing has been performed with reference to the recording time compensation processing execution flag in the metadata. Therefore, the compensation signal processing unit 33 performs reproduction time compensation processing on the audio signal from the reception unit 31 and generates a signal optimum for the viewer (listener).

Note that, when the use discrimination flag of the dummy head or the human ear microphone indicates the human ear microphone, the recording time compensation processing includes the recording time position compensation processing In a case where the use discrimination flag of the dummy head or the human ear microphone is the dummy head, there is no need to perform recording time position compensation processing.

<Operation Example of Recording/Reproducing System>

Next, recording processing of the recording apparatus 14 of FIG. 7 will be described with reference to the flowchart of FIG. 8. In step S101, the microphone 13 picks up sound from the sound source 11 and inputs the sound to the recording apparatus 14 as an analog audio signal.

In step S102, the microphone amplifier 22 amplifies the audio signal from the microphone 13 to the volume level corresponding to the operation signal from the volume slider 23 by the user, and outputs the amplified audio signal to the ADC 24.

In step S103, the ADC 24 performs AD conversion on the analog audio signal amplified by the microphone amplifier 22 to convert it into a digital audio signal, and outputs the converted signal to the metadata addition unit 26.

In step S104, the metadata addition unit 26 adds metadata from the metadata DB 25 to the audio signal from the ADC 24, and outputs it as an audio file to the recording time compensation processing unit 111. In step S105, the recording time compensation processing unit 111 performs recording time compensation processing on the audio signal of the audio file 102 on the basis of the characteristic difference between the two dummy heads. At this time, the recording time compensation processing unit 111 turns on the recording time compensation processing execution flag stored in the region indicated by 3 of the metadata region of the audio file 102, and supplies the audio file 102 to the transmission unit 27 and the storage unit 28.

In step S106, the transmission unit 27 transmits the audio file 102 to the reproducing apparatus 15 via the network 18.

Figure 9:
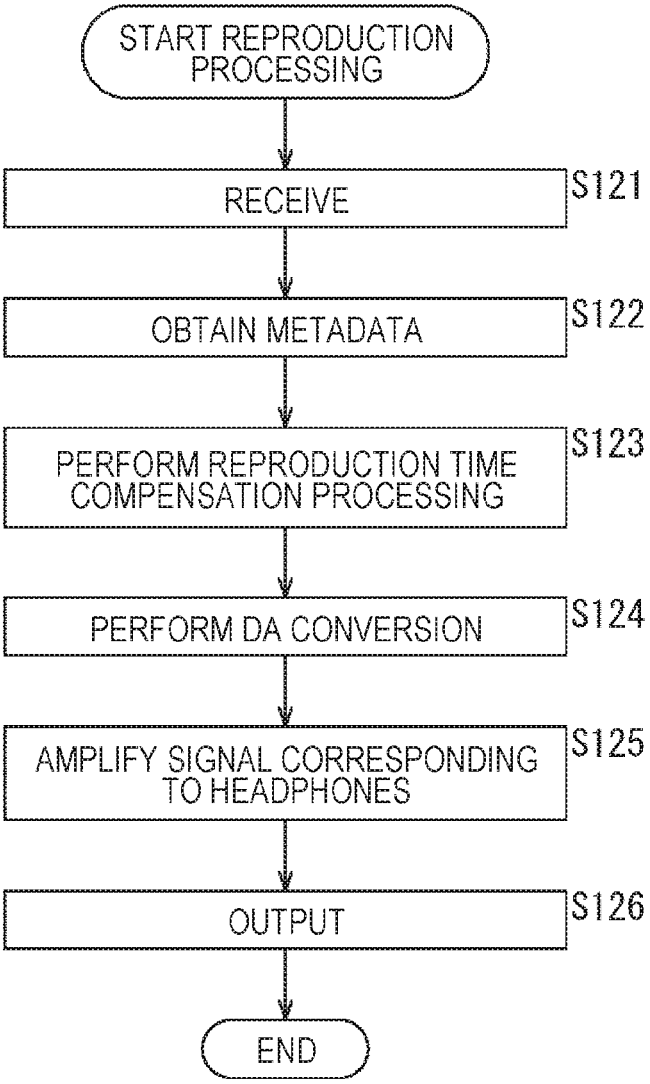
FIG. 9 is a flowchart illustrating reproduction processing of a reproducing apparatus.

Next, the reproduction processing of the reproducing apparatus 15 of FIG. 7 will be described with reference to the flowchart of FIG. 9.

Figure 8:
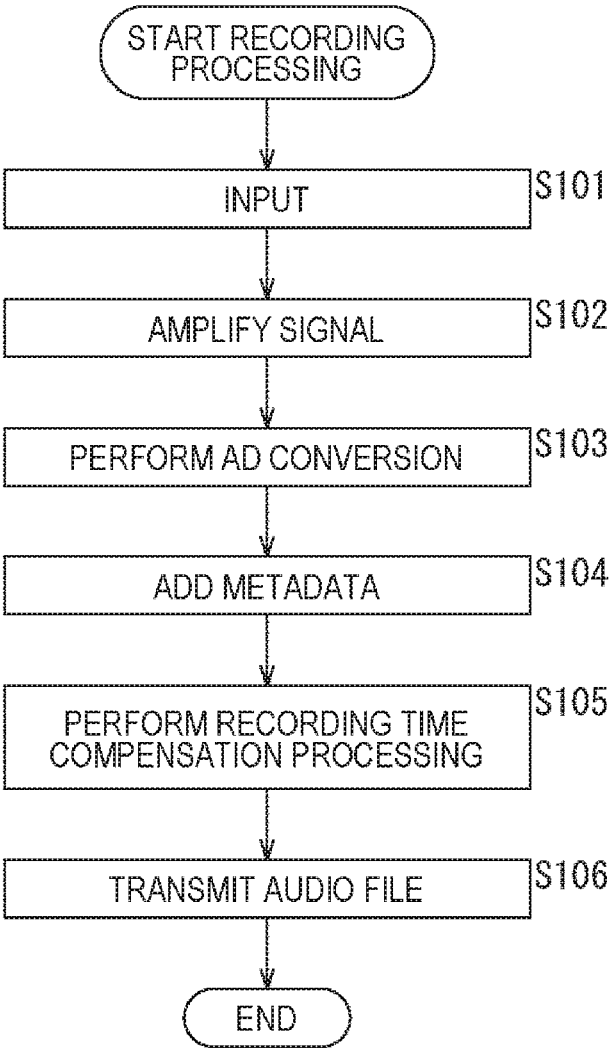
FIG. 8 is a flowchart illustrating recording processing of a recording apparatus.

In step S121, the reception unit 31 of the reproducing apparatus 15 receives the audio file 102 transmitted in step S106 of FIG. 8, obtains the audio signal and the metadata from the received audio file in step S122, outputs the obtained audio signal (digital) to the DAC 34, and accumulates the obtained metadata in the metadata DB 32.

The reproduction time compensation processing unit 61 confirms that the recording time compensation processing has been performed with reference to the recording time compensation processing execution flag in the metadata. Therefore, in step S123, the compensation signal processing unit 33 performs reproduction time compensation processing on the audio signal from the reception unit 31 and generates a signal optimum for the viewer (listener).

In step S124, the DAC 34 converts the digital signal compensated by the compensation signal processing unit 33 into an analog signal. The headphone amplifier 35 amplifies the audio signal from the DAC 34. In step S126, the headphones 16 output the sound corresponding to the audio signal from the DAC 34.

<Other Examples of a Recording/Reproducing System According to the Present Technology>

Figure 10:
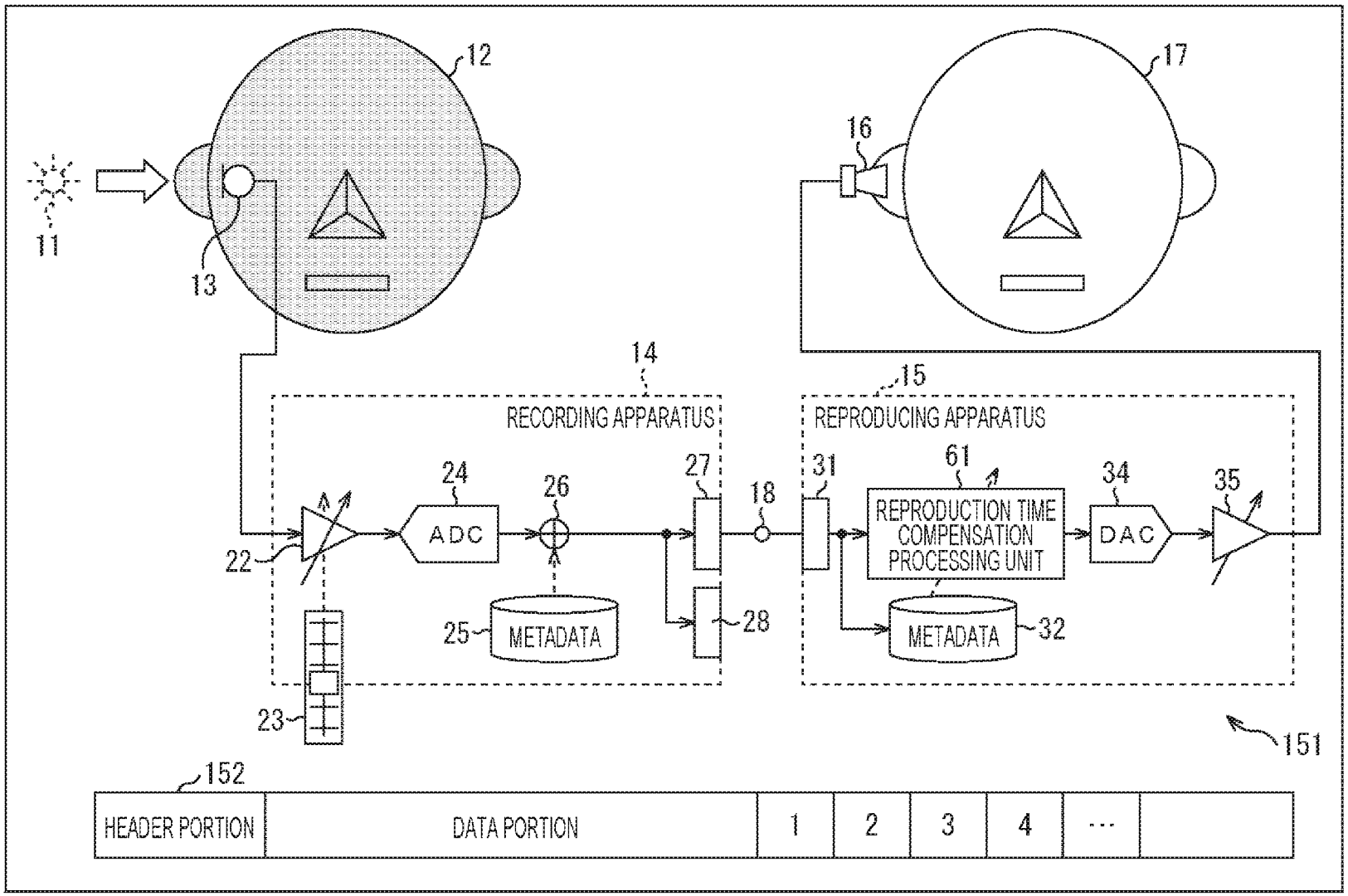
FIG. 10 is a block diagram illustrating an example of a recording/reproducing system in a case where recording time compensation processing is performed after transmission.

FIG. 10 is a diagram illustrating an example of a recording/reproducing system in a case where recording time compensation processing is performed before transmission. In the recording/reproducing system of the example of FIG. 10, information regarding the reference dummy head and the dummy head used in the recording is added as metadata in the recording and then transmitted. Thereafter, recording time compensation processing is performed on the basis of the metadata obtained on the receiving side.

The recording/reproducing system 151 in FIG. 10 is basically configured in a similar manner as the recording/reproducing system 1 in FIG. 1. An audio file 152 transmitted from the recording apparatus 14 to the reproducing apparatus 15 is configured in a similar manner as the audio file 102 in FIG. 7. However, in the audio file 152, the recording time compensation processing execution flag is set to off.

<Operation Example of Recording/Reproducing System>

Figure 11:
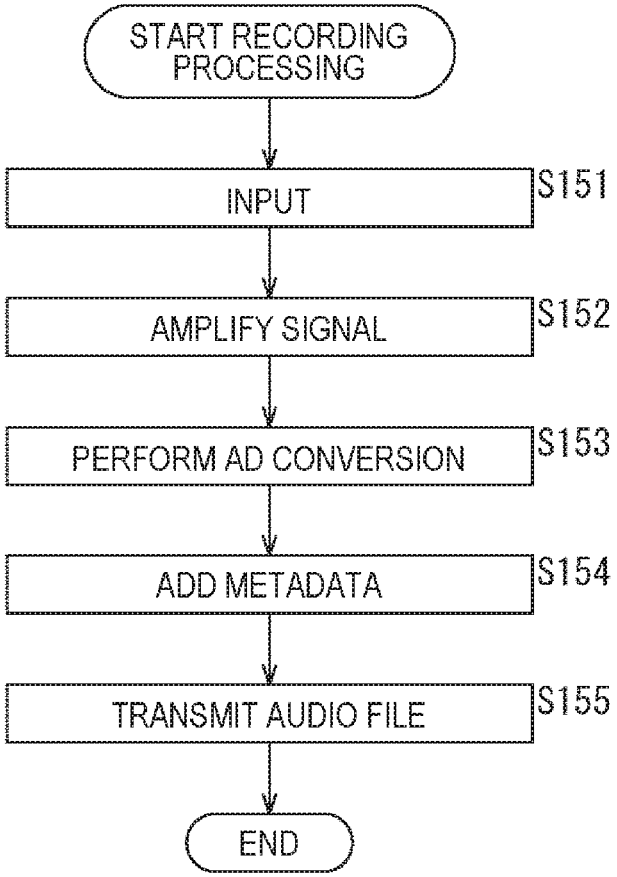
FIG. 11 is a flowchart illustrating recording processing of a recording apparatus.

Next, recording processing of the recording apparatus 14 of FIG. 10 will be described with reference to the flowchart of FIG. 11. In step S151, the microphone 13 picks up sound from the sound source 11 and inputs the sound to the recording apparatus 14 as an analog audio signal.

In step S152, the microphone amplifier 22 amplifies the audio signal from the microphone 13 to the volume level corresponding to the operation signal from the volume slider 23 by the user, and outputs the amplified audio signal to the ADC 24.

In step S153, the ADC 24 performs AD conversion on the analog audio signal amplified by the microphone amplifier 22 to convert it into a digital audio signal, and outputs the converted signal to the metadata addition unit 26.

In step S154, the metadata addition unit 26 adds the metadata from the metadata DB 25 to the audio signal from the ADC 24, and supplies the audio signal as the audio file to the transmission unit 27 and the storage unit 28. In step S155, the transmission unit 27 transmits the audio file 102 to the reproducing apparatus 15 via the network 18.

Figure 12:
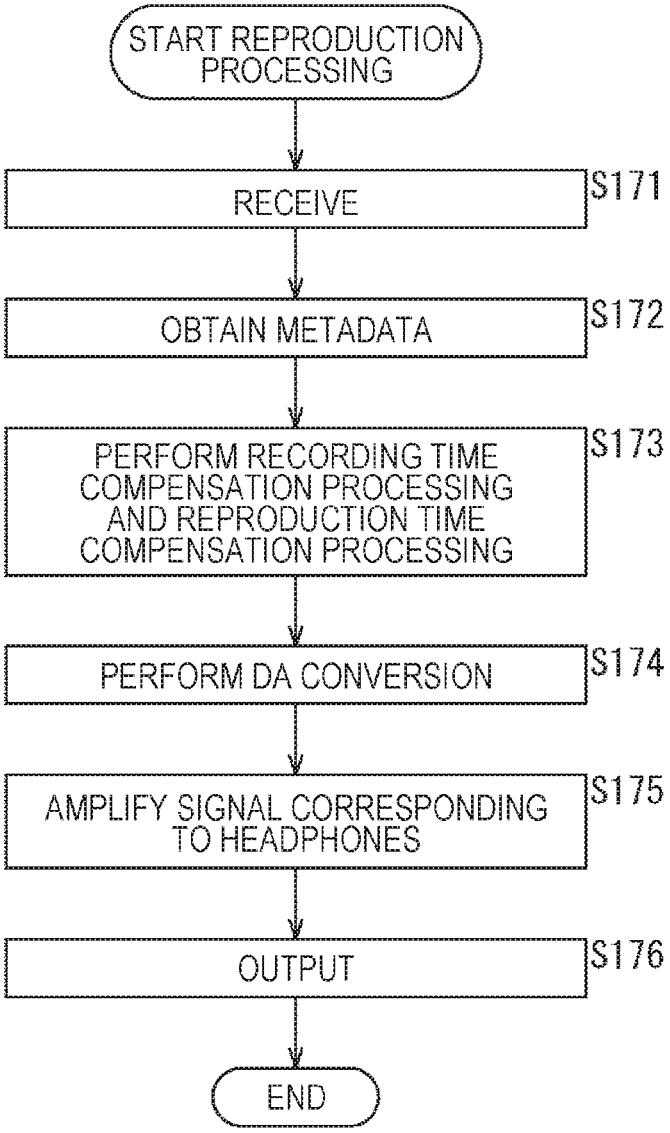
FIG. 12 is a flowchart illustrating reproduction processing of a reproducing apparatus.

Next, the reproduction processing of the reproducing apparatus 15 of FIG. 7 will be described with reference to the flowchart of FIG. 12.

In step S171, the reception unit 31 of the reproducing apparatus 15 receives the audio file 102 transmitted in step S155 of FIG. 10, obtains the audio signal and the metadata from the received audio file in step S172, outputs the obtained audio signal (digital) to the DAC 34, and accumulates the obtained metadata in the metadata DB 32.

In step S173, the compensation signal processing unit 33 performs a recording time compensation processing and a reproduction time compensation processing on the audio signal from the reception unit 31 and generates a signal optimum for the viewer (listener).

In step S174, the DAC 34 converts the digital signal compensated by the compensation signal processing unit 33 into an analog signal. The headphone amplifier 35 amplifies the audio signal from the DAC 34. In step S175, the headphones 16 output the sound corresponding to the audio signal from the DAC 34.

Note that, when the use discrimination flag of the dummy head or the human ear microphone indicates the human ear microphone, the recording time compensation processing includes the recording time position compensation processing In a case where the use discrimination flag of the dummy head or the human ear microphone is the dummy head, there is no need to perform recording time position compensation processing.

In addition, since frequency characteristics in the reproducing apparatus are generally unknown in many cases, there is an option not to apply the reproduction time compensation processing in a case where reproducing apparatus information cannot be obtained. Alternatively, processing of compensating for the effects of ear canal resonance alone may be performed on the assumption that the driver characteristic of the reproducing apparatus is flat.

As described above, the present technology adds metadata to the content in the recording of binaural content, making it possible to perform compensation to achieve a standard sound with the use of any type of device such as dummy head or microphone in recording of the binaural content.

Moreover, with the sensitivity information of the microphone used in the recording added as metadata, it is possible to appropriately adjust the output sound pressure in reproducing the content.

It is possible to compensate for the difference in the sound pressure at the microphone position between the sound pickup position and the eardrum position in a case where binaural content is picked up using human ears.

Meanwhile, in recent years, social media are used as a means of socializing with other people. Addition of metadata to binaural content of the present technology would lead to a binaural matching system as below similar to social media.

3. Third Embodiment

<Other Examples of a Binaural Matching System According to the Present Technology>

Figure 13:
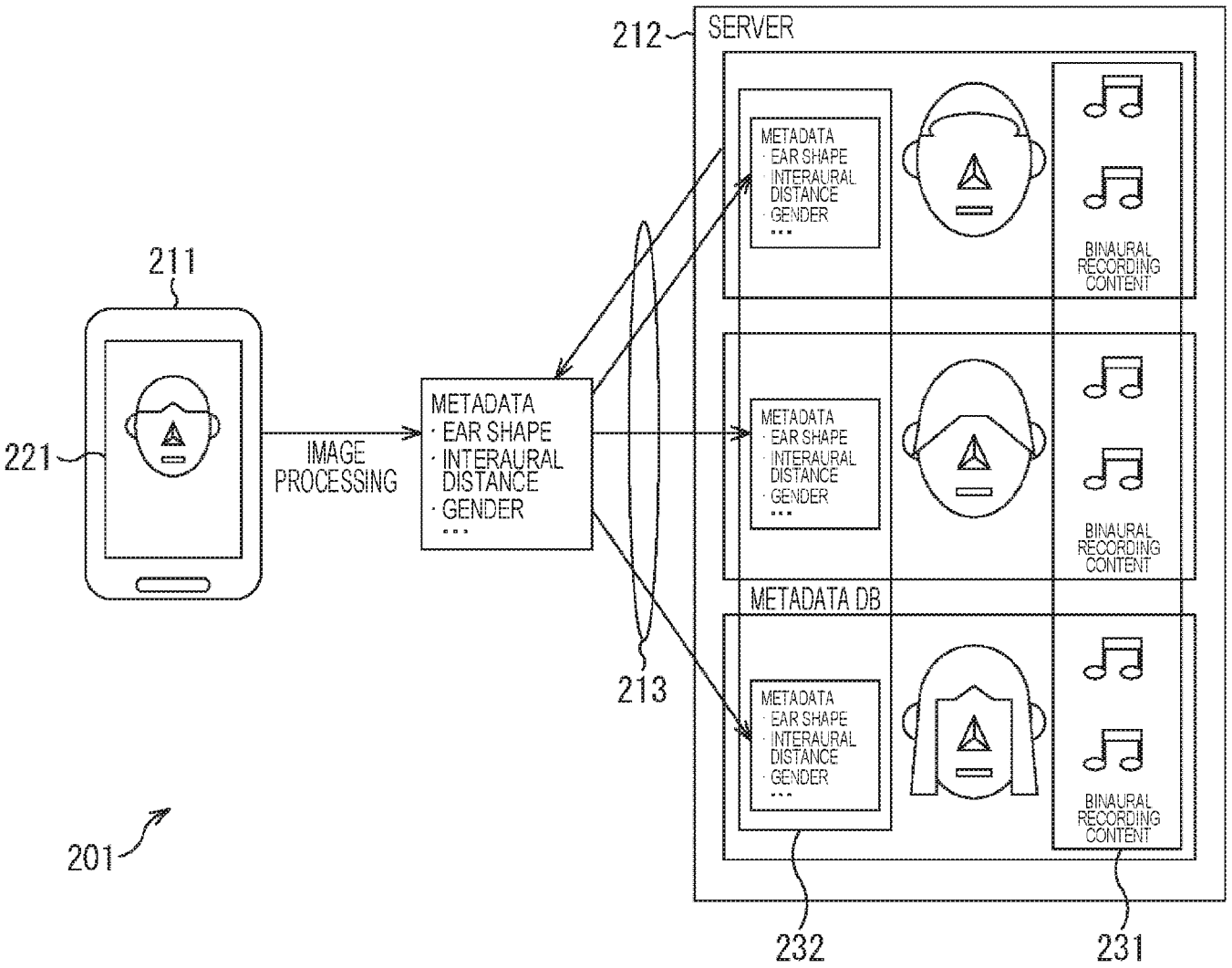
FIG. 13 is a block diagram illustrating an example of a binaural matching system according to the present technology.

FIG. 13 is a diagram illustrating an example of a binaural matching system according to the present technology.

In a binaural matching system 201 of FIG. 13, a smartphone (multifunctional mobile phone) 211 and a server 212 are connected via a network 213. Note that, although one smartphone 211 and one server 212 are connected to the network 213 in the figure, there are actually connections of a plurality of smartphones 211 and a plurality of servers 212.

The smartphone 211 has a touch screen 221 that is now displaying an owner's face image captured by a camera (not illustrated) or the like. The smartphone 211 performs image analysis on the face image and generates metadata (for example, user's ear shape, the interaural distance, gender, and hair style, that is, the metadata of facial features) with reference to FIG. 1 and transmits the generated metadata to the server 212 via the network 213.

The smartphone 211 receives metadata having characteristics close to those of the transmitted metadata together with the binaural recording content corresponding to the metadata, and reproduces the binaural recording content on the basis of the metadata.

The server 212 contains, for example, a content DB 231 and metadata DB 232. The content DB 231 contains registered binaural recording content sent from another user, obtained with binaural recording performed by the other user at a concert hall or the like using a smartphone or a portable personal computer. The metadata DB 232 registers metadata (for example, ear shape, interaural distance, gender, and hairstyle) related to the user who recorded the content in association with the binaural recording content registered in the binaural recording content DB 231.

After receiving the metadata from the smartphone 211, the server 212 searches the metadata DB 232 for metadata having characteristics close to those of the received metadata, and searches the content DB 231 for binaural recording content corresponding to the metadata. Then, the server 212 transmits the binaural recording content having similar metadata characteristic from the content DB 231 to the smartphone 211 via the network 213.

With this configuration, it is possible to obtain binaural recording content recorded by another user having similar skeleton and ear shapes. That is, it is possible to receive content that can give higher realistic feeling.

Figure 14:
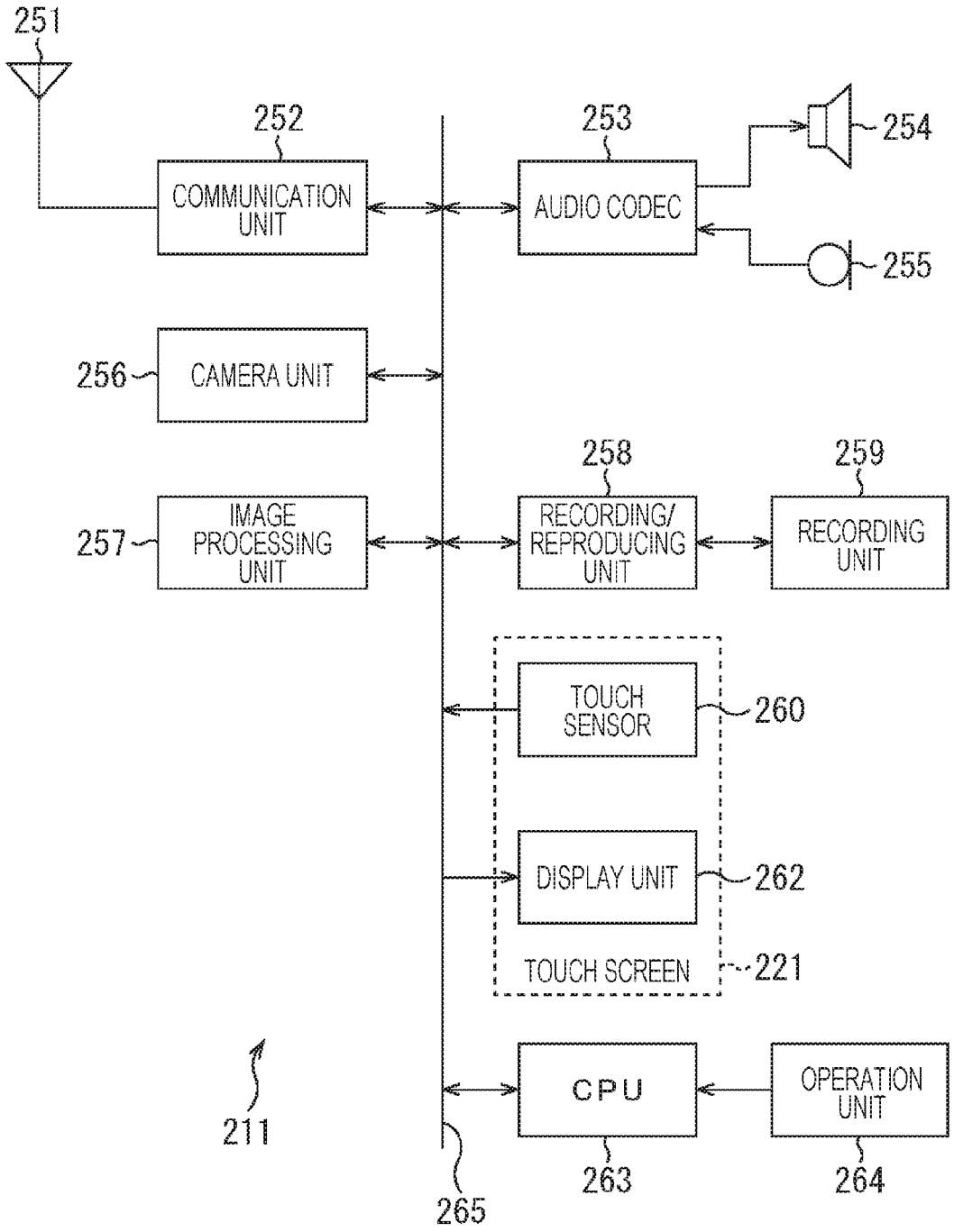
FIG. 14 is a block diagram illustrating a configuration example of a smartphone.

FIG. 14 is a block diagram illustrating a configuration example of the smartphone 211.

The smartphone 211 includes a communication unit 252, an audio codec 253, a camera unit 256, an image processing unit 257, a recording/reproducing unit 258, a recording unit 259, a touch screen 221 (display device), and a central processing unit (CPU) 263. These components are connected to each other via a bus 265.

In addition, the communication unit 252 is connected with an antenna 251, while the audio codec 253 is connected with a speaker 254 and a microphone 255. Furthermore, the CPU 263 is connected with an operation unit 264 such as a power button.

The smartphone 211 performs processing of various modes such as a communication mode, a speech mode, and a photographing mode.

In a case where the smartphone 211 performs processing of the speech mode, an analog audio signal generated by the microphone 255 is input to the audio codec 253. The audio codec 253 converts analog audio signals into digital audio data, compresses the converted audio data so as to be supplied to the communication unit 252. The communication unit 252 performs modulation processing, frequency conversion processing, or the like, on the compressed audio data, and generates a transmission signal. Then, the communication unit 252 supplies the transmission signal to the antenna 251 to be transmitted to a base station (not illustrated).

The communication unit 252 also performs amplification, frequency conversion processing, demodulation processing, or the like on the received signal received by the antenna 251, so as to obtain digital audio data transmitted from a communication partner, and supplies the obtained digital audio data to the audio codec 253. The audio codec 253 decompresses the audio data, and converts the decompressed audio data into an analog audio signal, so as to be output to the speaker 254.

Furthermore, in a case where the smartphone 211 performs e-mail transmission as the processing of the communication mode, the CPU 263 receives texts input by the user operating on the touch screen 221, and displays the texts on the touch screen 221. The CPU 263 further generates e-mail data on the basis of an instruction or the like input by the user's operation on the touch screen 221, and supplies the e-mail data to the communication unit 252. The communication unit 252 performs modulation processing, frequency conversion processing, or the like, on the e-mail data and transmits an obtained transmission signal via the antenna 251.

The communication unit 252 also performs amplification, frequency conversion processing, demodulation processing, or the like, on the reception signal received via the antenna 251, and restores the e-mail data. The e-mail data is supplied to the touch screen 221 and displayed on the display unit 262.

Note that the smartphone 211 can also cause the recording/reproducing unit 258 to record the received e-mail data in the recording unit 259. Examples of the recording unit 259 include a semiconductor memory such as a random access memory (RAM) and a built-in flash memory, a hard disk, and a removable medium such as a magnetic disk, a magneto-optical disk, an optical disk, a universal serial bus (USB) memory, or a memory card.

In a case where the smartphone 211 performs processing of the photographing mode, the CPU 263 supplies a photographing preparation operation start command to the camera unit 256. The camera unit 256 is formed with a rear camera having a lens on a rear surface (surface opposed to the touch screen 221) of the smartphone 211 in the normal use state and a front camera having a lens on a front surface (surface on which the touch screen 221 is disposed). The rear camera is used when the user photographs a subject other than oneself while the front camera is used when the user photographs oneself as a subject.

The rear camera or the front camera of the camera unit 256 starts shooting preparation operation such as ranging (AF) operation and tentative shooting in response to a shooting preparation operation start command supplied from the CPU 263. The CPU 263 supplies a photographing command to the camera unit 256 in response to the photographing command input by the user's operating on the touch screen 221. The camera unit 256 performs main photographing in response to the photographing command. The photographed image photographed by the tentative photographing or the main photographing is supplied to the touch screen 221 and displayed on the display unit 262. Furthermore, the photographed image obtained in the main photographing is also supplied to the image processing unit 257, and then encoded by the image processing unit 257. The encoded data generated as a result of encoding is supplied to the recording/reproducing unit 258 and then, recorded in the recording unit 259.

The touch screen 221 is configured by laminating a touch sensor 260 on a display unit 262 including an LCD.

The CPU 263 calculates a touch position corresponding to information from the touch sensor 260 by user's operation, so as to determine the touch position.

Furthermore, the CPU 263 turns on or off the power supply of the smartphone 211 in a case where the power button of the operation unit 264 is pressed by the user.

The CPU 263 executes a program recorded in the recording unit 259, for example, to perform the above-described processing. In addition, this program can be received at the communication unit 252 via a wired or wireless transmission medium and be installed in the recording unit 259. Alternatively, the program can be installed in the recording unit 259 beforehand.

Figure 15:
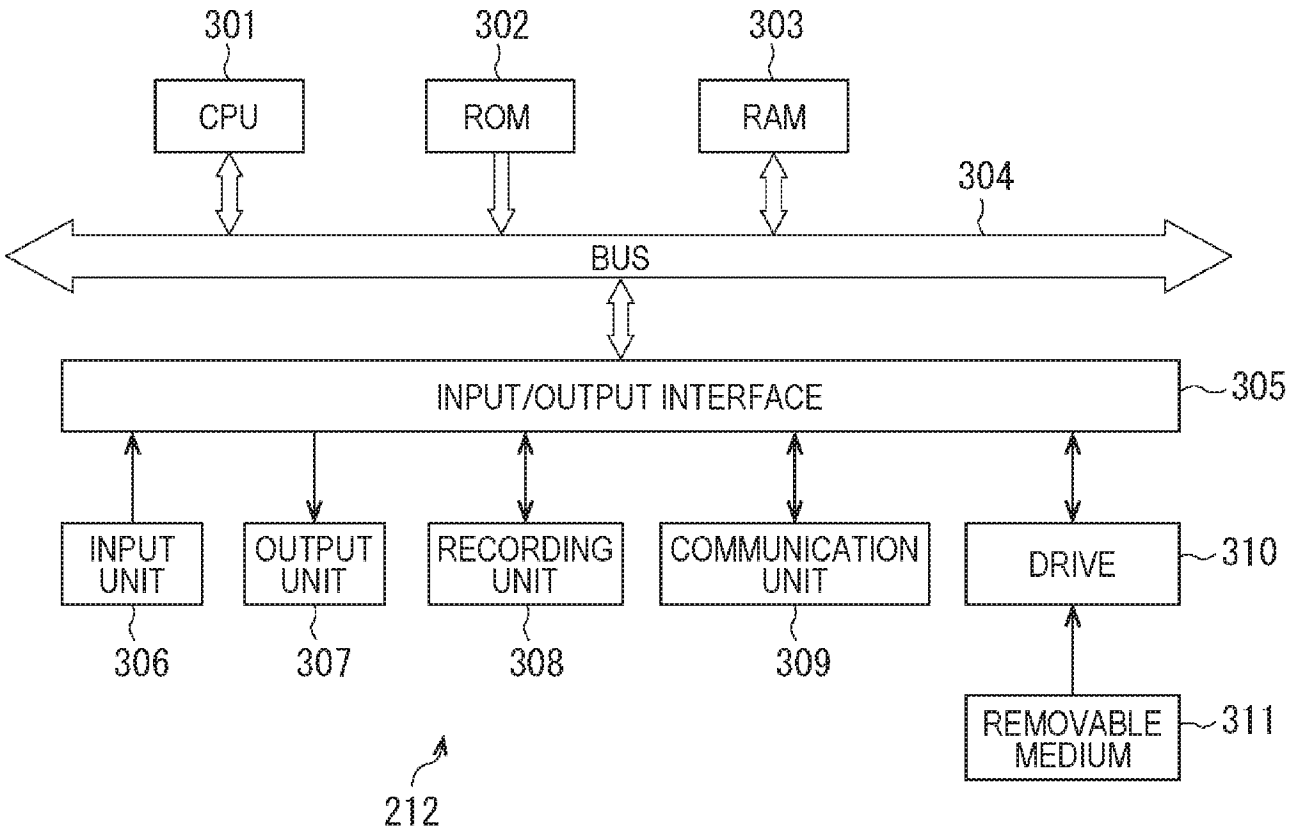
FIG. 15 is a block diagram illustrating an exemplary configuration of a server.

FIG. 15 is a block diagram illustrating an exemplary hardware configuration of the server 212.

In the server 212, a CPU 301, a read only memory (ROM) 302, and a random access memory (RAM) 303 are mutually connected by a bus 304.

The bus 304 is further connected with an input/output interface 305. The input/output interface 305 is connected with an input unit 306, an output unit 307, a storage unit 308, a communication unit 309, and a drive 310.

The input unit 306 includes a key board, a mouse, a microphone, and the like. The output unit 307 includes a display, a speaker, and the like. The storage unit 308 includes a hard disk, a non-volatile memory, and the like. The communication unit 309 includes a network interface and the like. The drive 310 drives a removable medium 311 including a magnetic disk, an optical disk, a magneto-optical disk, a semiconductor memory, or the like.

In the server 212 configured as described above, for example, the CPU 301 loads the program stored in the storage unit 308 to the RAM 303 via the input/output interface 305 and the bus 304 and executes the program. With this configuration, the above-described series of processing is performed.

The program executed by the computer (CPU 301) can be recorded and supplied in the removable medium 311. The removable medium 311 includes, for example, a package medium such as a magnetic disk (including a flexible disk), an optical disk (including compact disc-read only memory (CD-ROM) and a digital versatile disc (DVD)), a magneto-optical disk, or a semiconductor memory. In addition, alternatively, the program can be provided via a wired or wireless transmission medium including a local area network, the Internet, and digital satellite broadcasting.

On a computer, a program can be installed in the storage unit 308 via the input/output interface 305, by attaching the removable medium 311 to the drive 310. In addition, the program can be received at the communication unit 309 via a wired or wireless transmission medium and be installed in the storage unit 308. Alternatively, the program can be installed in the ROM 302 or the storage unit 308 beforehand.

<Example of Operation of Binaural Matching System>

Figure 16:
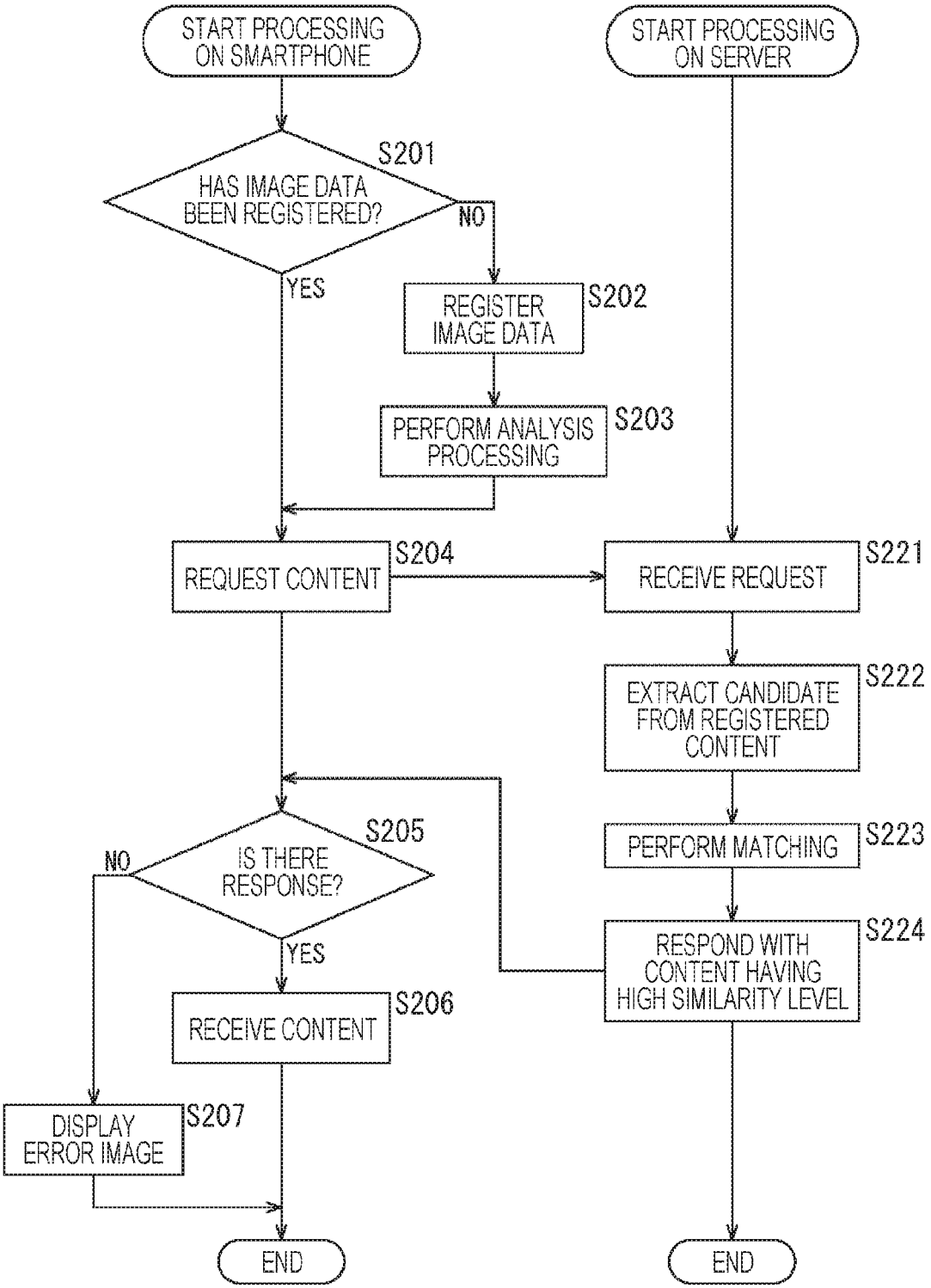
FIG. 16 is a flowchart illustrating a processing example of a binaural matching system.

Next, exemplary processing on the binaural matching system will be described with reference to the flowchart of FIG. 16.

In access to the server 212, the CPU 263 of the smartphone 211 determines in step S201 whether or not the user's own face image data has been registered. In a case where it is determined in step S201 that the face image data has already been registered, steps S202 and S203 are skipped, and the processing proceeds to step S204.

In a case where it is determined in step S201 that the face image data has not been registered, the CPU 263 registers the user's own face image data in step S202, and causes the image processing unit 257 to perform analysis processing on the registered image data in step S203. Analysis results generated include metadata (for example, user's ear shape, interaural distance, and gender, that is, metadata of facial features).

In step S204, the CPU 263 controls the communication unit 252 to transmit the metadata to the server 212 to request content.

In step S221, the CPU 301 of the server 212 receives a request via the communication unit 309. At this time, the communication unit 309 also receives metadata. In step S222, the CPU 301 extracts candidates from the content registered in the content DB 231. In step S223, the CPU 301 performs matching between the received metadata and the metadata in the metadata DB 232. In step S224, the CPU 301 responds to the smartphone 211 with the content having a high similarity level to the metadata.

In step S205, the CPU 263 of the smartphone 211 determines whether or not there is a response from the server 212. In a case where it is determined in step S205 that there is a response, the processing proceeds to step S206. In step S206, the CPU 301 causes the communication unit 252 to receive the content.

In contrast, in a case where it is determined in step S205 that there is no response, the processing proceeds to step S207. In step S207, the CPU 263 causes the display unit 262 to display an error image indicating that there is an error.

Note that, while the above description is an example in which metadata extracted by image analysis is transmitted to the server to select content having a high similarity level to the metadata, it is also allowable to transmit the image itself to the server, and the content may be selected by using metadata extracted by image analysis on the server. In short, metadata extraction may be performed either on the user side or on the server side.

As described above, according to the present technology, with processing of adding metadata to binaural content in the recording of the binaural content, it is possible to implement a function of analyzing a self-shot image and then receiving recorded data having similar characteristics and also possible to use this technology in social media.

Note that the program executed by the computer may be a program processed in a time series in an order described in the present description, or can be a program processed in a necessary stage such as being called.

Further, in the present specification, each of the steps describing the program recorded on the recording medium includes not only processing performed in time series along the described order, but also processing executed in parallel or separately, when it is not necessarily processed in time series.

Moreover, in the present specification, a system represents an entire apparatus including a plurality of devices (apparatuses).

For example, the present disclosure can be configured as a form of cloud computing in which one function is shared in cooperation for processing among a plurality of apparatuses via a network.

Alternatively, a configuration described above as a single apparatus (or processing unit) may be divided and configured as a plurality of apparatuses (or processing units). Conversely, a configuration described above as a plurality of apparatuses (or processing units) may be integrated and configured as a single apparatus (or processing unit). In addition, configurations other than the above-described configurations may, of course, be added to the configurations of the apparatuses (or the processing units). Furthermore, as long as configurations or operation are substantially the same in the entire system, the configurations of certain apparatuses (or processing units) may be partially included in the configurations of the other apparatuses (or other processing units) Accordingly, the present technology are not limited to the above-described embodiments but can be modified in a variety of ways within a scope according to the present technology.

Hereinabove, the preferred embodiments of the present disclosure have been described above with reference to the accompanying drawings, while the present disclosure is not limited to the above examples. A person skilled in the art in the technical field of the present disclosure finds it understandable to reach various alterations and modifications within the technical scope of the appended claims, and it should be understood that they will naturally come within the technical scope of the present disclosure.

Note that the present technology can also be configured as follows.

(1) An information processing apparatus including a transmission unit that transmits metadata related to a recording environment of binaural content, together with the binaural content.

(2) The information processing apparatus according to (1), in which the metadata is an interaural distance of a dummy head or a head used in recording of the binaural content.

(3) The information processing apparatus according to (1) or (2), in which the metadata is a use flag indicating which of a dummy head and human ears is used in the recording of the binaural content.

(4) The information processing apparatus according to any of (1) to (3), in which the metadata is a position flag indicating which of a vicinity of an eardrum or a vicinity of a pinna is used as a microphone position in the recording of the binaural content.

(5) The information processing apparatus according to (4), in which compensation processing is performed in the vicinity of 1 kHz to 4 kHz in a case where the position flag indicates the vicinity of the pinna.

(6) The information processing apparatus according to (4), in which reproduction time compensation processing being ear canal characteristic compensation processing when an ear hole is closed is performed in accordance with the position flag.

(7) The information processing apparatus according to (6), in which the reproduction time compensation processing is performed so as to have dips in the vicinity of 5 kHz and vicinity of 7 kHz.

(8) The information processing apparatus according to any of (1) to (7), in which the metadata is information regarding a microphone used in the recording of the binaural content.

(9) The information processing apparatus according to any of (1) to (8), in which the metadata is information regarding gain of a microphone amplifier used in the recording of the binaural content.

(10) The information processing apparatus according to any of (1) to (9), further including a compensation processing unit that performs recording time compensation processing for compensating for a sound pressure difference in a space from a position of sound source to a position of a microphone in recording, in which the metadata includes a compensation flag indicating whether or not the recording time compensation processing has been completed.

(11) An information processing method including transmitting, using an information processing apparatus, metadata related to a recording environment of binaural content, together with the binaural content.

(12) An information processing apparatus including a reception unit that receives metadata related to a recording environment of binaural content, together with the binaural content.

(13) The information processing apparatus according to (12), further including a compensation processing unit that performs compensation processing in accordance with the metadata.

(14) The information processing apparatus according to (12) or (13), in which transmitted content selected by matching using a transmitted image is received.

(15) An information processing method including receiving, using an information processing apparatus, metadata related to a recording environment of binaural content, together with the binaural content.

REFERENCE SIGNS LIST

1 Recording/reproducing system
11 Sound source
12, 12-1, 12-2 Dummy head
13, 13-1, 13-2 Microphone
14 Recording apparatus
15 Reproducing apparatus
16 Headphones
17 User
18 Network
22 Microphone amplifier
23 Slider
24 ADC
25 Metadata DB
26 Metadata addition unit
27 Transmission unit
28 Storage unit
31 Reception unit
32 Metadata DB
33 Compensation signal processing unit
34 DAC
35 Headphone amplifier
51 Recording/reproducing system
61 Reproduction time compensation processing unit
62 Display unit
63 Operation unit
81 User
82 Binaural microphone
101 Recording/reproducing system
102 Audio file
111 Recording time compensation processing unit
151 Recording/reproducing system
152 Audio file
201 Binaural matching system
211 Smartphone
212 Server
213 Network

221 Touch screen
231 Content DB
232 Metadata DB
252 Communication unit
257 Image processing unit
263 CPU
301 CPU
309 Communication unit

The invention claimed is:

1. An information processing apparatus, comprising:
a central processing unit (CPU) configured to:
execute a recording time compensation process, wherein
the recording time compensation process includes compensation of a sound pressure difference between a sound pressure at a position of a reference dummy head and a sound pressure at a position of one of a dummy head or a human ear type binaural microphone, and
the reference dummy head is different from each of the dummy head or the human ear type binaural microphone; and
control transmission of binaural content and transmission of metadata of the binaural content, wherein
the metadata is associated with an environment in which the binaural content is recorded, and
the metadata comprises a compensation flag that indicates a completion of the recording time compensation process.

2. The information processing apparatus according to claim 1, wherein the metadata is an interaural distance of one of the dummy head or a human head utilized to record the binaural content.

3. The information processing apparatus according to claim 2, wherein
the metadata further comprises a position flag that indicates a position of a microphone,
the position of the microphone is associated with the recordation of the binaural content,
the position of the microphone is one of within proximity of an eardrum or within proximity of a pinna,
the eardrum is associated with the dummy head, and
the pinna is associated with the human head.

4. The information processing apparatus according to claim 3, wherein
the CPU is further configured to execute a compensation process within frequencies ranging from 1 kHz to 4 kHz,
the execution of the compensation process is based on the position flag, and
the position flag indicates the position of the microphone that is within the proximity of the pinna.

5. The information processing apparatus according to claim 3, wherein
the CPU is further configured to execute a reproduction time compensation process based on the position flag,
the reproduction time compensation process is executed as an ear canal characteristic compensation process based on closure of an ear hole, and
the ear hole is associated with the human head.

6. The information processing apparatus according to claim 5, wherein
the CPU is further configured to execute the reproduction time compensation process, and
dips in a vicinity of 5 kHz and a vicinity of 7 kHz are based on the reproduction time compensation process.

7. The information processing apparatus according to claim 3, wherein
the metadata is information associated with the one of the dummy head or the human ear type binaural microphone, and
the one of the dummy head or the human ear type binaural microphone is associated with the recordation of the binaural content.

8. The information processing apparatus according to claim 7, wherein
the metadata further comprises information associated with a gain of a microphone amplifier,
the microphone amplifier is associated with the recordation of the binaural content, and
the gain of the microphone amplifier corresponds to an amplitude gain of a sound signal associated with the binaural content.

9. The information processing apparatus according to claim 1, wherein
the metadata further comprises a use flag that indicates the one of the dummy head or the human ear type binaural microphone, and
the one of the dummy head or the human ear type binaural microphone is associated with the recordation of the binaural content.

10. An information processing method, comprising:
executing a recording time compensation process, wherein
the recording time compensation process includes compensation of a sound pressure difference between a sound pressure at a position of a reference dummy head and a sound pressure at a position of one of a dummy head or a human ear type binaural microphone, and
the reference dummy head is different from each of the dummy head or the human ear type binaural microphone;
transmitting binaural content; and
transmitting metadata of the binaural content, wherein
the metadata is associated with an environment in which the binaural content is recorded, and
the metadata comprises a compensation flag indicating a completion of the recording time compensation process.

11. An information processing apparatus, comprising:
a central processing unit (CPU) configured to
control reception of binaural content and reception of first metadata of the binaural content, wherein
the first metadata is associated with an environment in which the binaural content is recorded,
the first metadata comprises a compensation flag that indicates a completion of a recording time compensation process,
the recording time compensation process includes compensation of a sound pressure difference between a sound pressure at a position of a reference dummy head and a sound pressure at a position of one of a dummy head or a human ear type binaural microphone, and
the reference dummy head is different from each of the dummy head or the human ear type binaural microphone.

12. The information processing apparatus according to claim 11, wherein the CPU is further configured to execute a compensation process based on the first metadata.

13. The information processing apparatus according to claim 12, wherein the CPU is further configured to:

control transmission of second metadata associated with an image; and control the reception of the binaural content and the reception of first metadata, based on the transmitted second metadata.

14. An information processing method, comprising:

receiving binaural content; and receiving metadata of the binaural content, wherein the metadata is associated with an environment in which the binaural content is recorded, the metadata comprises a compensation flag that indicates a completion of a recording time compensation process, the recording time compensation process includes compensation of a sound pressure difference between a sound pressure at a position of a reference dummy head and a sound pressure at a position of one of a dummy head or a human ear type binaural microphone, and the reference dummy head is different from each of the dummy head or the human ear type binaural microphone.

* * * * *